US006308397B1

(12) United States Patent
Nishimura et al.

(10) Patent No.: US 6,308,397 B1
(45) Date of Patent: Oct. 30, 2001

(54) METHOD FOR MANUFACTURING FRICTION PLATE

(75) Inventors: Shigeharu Nishimura, Shizuoka-ken; Nobuhiro Horiuchi, Fukuroi, both of (JP)

(73) Assignee: NSK-Warner K.K., Tokyo (JP)

( * ) Notice: Subject to any disclaimer, the term of this patent is extended or adjusted under 35 U.S.C. 154(b) by 0 days.

(21) Appl. No.: 09/332,147

(22) Filed: Jun. 14, 1999

(30) Foreign Application Priority Data

Jun. 15, 1998 (JP) ..... 10-167088

(51) Int. Cl.[7] ..... B21D 35/00
(52) U.S. Cl. ..... 29/469.5; 29/412; 192/107 R
(58) Field of Search ..... 29/469.5, 412, 29/417, 411; 192/107 R; 72/324, 327

(56) References Cited

U.S. PATENT DOCUMENTS

| | | | | |
|---|---|---|---|---|
| 3,854,359 | * | 12/1974 | Tagami | 83/212 |
| 4,989,696 | * | 2/1991 | Buell | 29/412 |
| 5,571,372 | * | 11/1996 | Buell | 29/412 |
| 6,019,205 | * | 2/2000 | Willwerth et al. | 29/417 |

* cited by examiner

*Primary Examiner*—David P. Bryant
*Assistant Examiner*—Jermie E. Cozart
(74) *Attorney, Agent, or Firm*—Miles & Stockbridge P.C.

(57) ABSTRACT

The present invention provides a method for manufacturing friction plates obtained by adhering friction members to substantially annular core plates, comprising the steps of simultaneously stamping a plurality of coaxial core plates having different diameters with a joint portion remaining therebetween, preliminarily adhering friction member segments to the stamped plural core plates, and stamping the joint portion during or after a main adhering step following the preliminarily adhering step.

14 Claims, 4 Drawing Sheets

METHOD FOR MANUFACTURING FRICTION PLATE

BACKGROUND OF THE INVENTION

1. Field of the Invention

The present invention relates to a method for manufacturing a friction plate used for an automatic transmission and/or a lock-up clutch of a vehicle.

2. Related Background Art

In order to manufacture a plurality of friction plates having different diameters, for example as shown in FIG. 4, large and small core plates were separately formed by a press and the like, and friction member segments were independently adhered to the core plates.

In FIG. 4, first of all, in a step (A), a large-diametered core plate 11 and a small-diametered core plate 12 having a diameter smaller than the core plate 11 are simultaneously stamped from a plate material, and independent large-diametered core plate 11 and small-diametered core plate 12 are completely separate.

Then, in a step (B), friction member segments 16 stamped from a friction tape 13 and friction member segments 14 stamped from a friction tape 15 are adhered to the large-diametered core plate 11 and the small-diametered core plate 12, respectively. This operation is effected along a circumferential direction. When the adhesion of the friction member segments is completed, as shown in a step (C), a large-diametered frictional plate 30 and a small-diametered friction plate 40 are separately formed independently. In this case, main adhesion is effected.

However, the aforementioned conventional manufacturing method has the following problems.

There is no consistency from the stamping of the press from the adhesion, and the number of adhering processes is increased depending upon the number of kinds of the friction plate, and, in set change, if the adhesion is effected in the same process, twice the time is required for the number of kinds of the friction plate.

Further, since the adhesion of each friction member segment to the core plate is repeated, it is difficult to reduce the manufacturing time.

SUMMARY OF THE INVENTION

Accordingly, an object of the present invention is to solve the above-mentioned problems.

To solve the above problems, the present invention provides in one of its aspects, a method for manufacturing friction plates obtained by adhering friction members to substantially annular core plates, comprising the steps of simultaneously stamping a plurality of coaxial core plates having different diameters with remaining joint portions therebetween, preliminarily adhering friction member segments to the stamped plural core plates, and stamping the joint portions during or after a main adhering step following the preliminarily adhering step.

According to the present invention, consistency from the stamping of the press from the adhesion can be established. Further, by supplying the friction member segments in a unique manner, yield of material can be maintained in the same level as the conventional case.

Furthermore, since a pitch for supplying the friction member segments is varied so that the friction member segments can simultaneously be adhered to diametrically opposed portions of the same core plate, the repeated adhering time can be reduced to half.

DETAILED DESCRIPTION OF THE PREFERRED EMBODIMENTS

Figure 1:
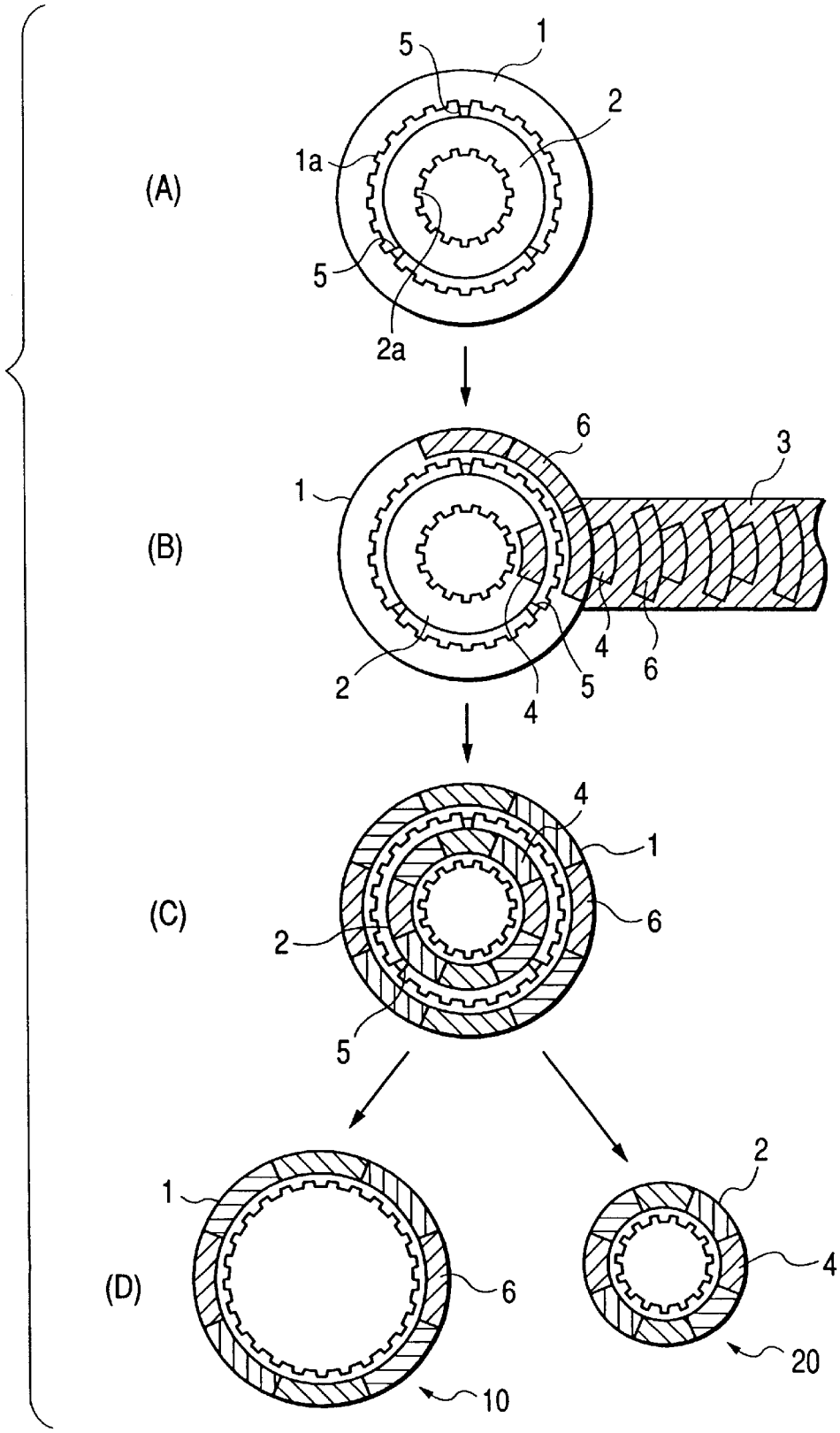
FIG. 1 is a plan view showing a flow of manufacturing processes in a first embodiment of the present invention.

The present invention will now be fully explained in connection with embodiments thereof with reference to the accompanying drawings. Incidentally, in the drawings, same elements are designated by the same reference numerals.

(First Embodiment) FIG. 1 is a plan view showing a flow of manufacturing processes in a first embodiment of the present invention.

FIG. 1 shows one example of a flow of processes or steps when two large and small friction plates having different diameters are manufactured. First of all, in a step (A), a substantially annular large-diametered core plate 1 having an inner spline 1*a* to be engaged by a rotary member (not shown) and a substantially annular small core plate 2 having an inner spline 2*a* to be engaged by a rotary member (not shown) and having an outer diameter smaller than an inner diameter of the large core plate 1 are formed by simultaneously stamping them from a steel plate having a predetermined thickness by means of the press (not shown). After stamping, a substantially annular gap is defined between the large core plate 1 and the small core plate 2.

In this case three joint portions 5 equidistantly spaced in a circumferential direction are provided for joining teeth of the spline 1*a* of the large core plate 1 and the outer periphery of the small core plate 2. Accordingly, due to the presence of the joint portions 5, the large core plate 1 is integrally joined to the small core plate 2 in this step. Incidentally, while an example that the number of the joint portions arranged along the circumferential direction is three was explained, such number can freely be selected to one, two, four or more.

In the step (A), to adhere friction members onto upper surfaces of the large core plate 1 and the small core plate 2, adhesive for main adhesion is coated on the plates, and after such adhesive is dried, adhesive for preliminary adhesion is coated.

The large and small core plates on which the adhesives has been coated in this way are conveyed to a step (B), where a plurality of friction member segments are adhered. A friction tape 3 from which the friction member segments are to be stamped is supplied radially with respect to the large and small core plates, and friction member segments 4 for the small core plate 2 and friction member segments 6 for the large core plate 1 are stamped from the friction tape 3, and the friction member segments are rested on the respective core plates. Thereafter, pressurization and preliminary adhesion are effected by an urging device (not shown).

Since a pitch between the friction member segment 4 and the friction member segment 6 is equal to a distance between the large core plate 1 and the small core plate 2, the friction member segments 4, 6 can be stamped simultaneously, and thus, two friction member segments are stamped by single stamping. In this step, the large core plate 1 and the small core plate 2 are still interconnected via the joint portions 5.

The article in which the preliminary adhesion of the friction member segments is finished is conveyed to a step (C), where heat and pressure are simultaneously applied by a main adhering device (not shown), thereby effecting the main adhesion of the friction members to the core plates.

Lastly, in a step (D), after the main adhesion, the joint portions 5 are stamped by punch(es), (not shown), with the result that the large core plate 1 and the small core plate 2 are separated and formed as two kinds of the friction plates having different diameters to which the friction members were adhered. Incidentally, the stamping and separating step may be effected simultaneously with the main adhesion in the step (C).

(Second Embodiment)

Figure 2:
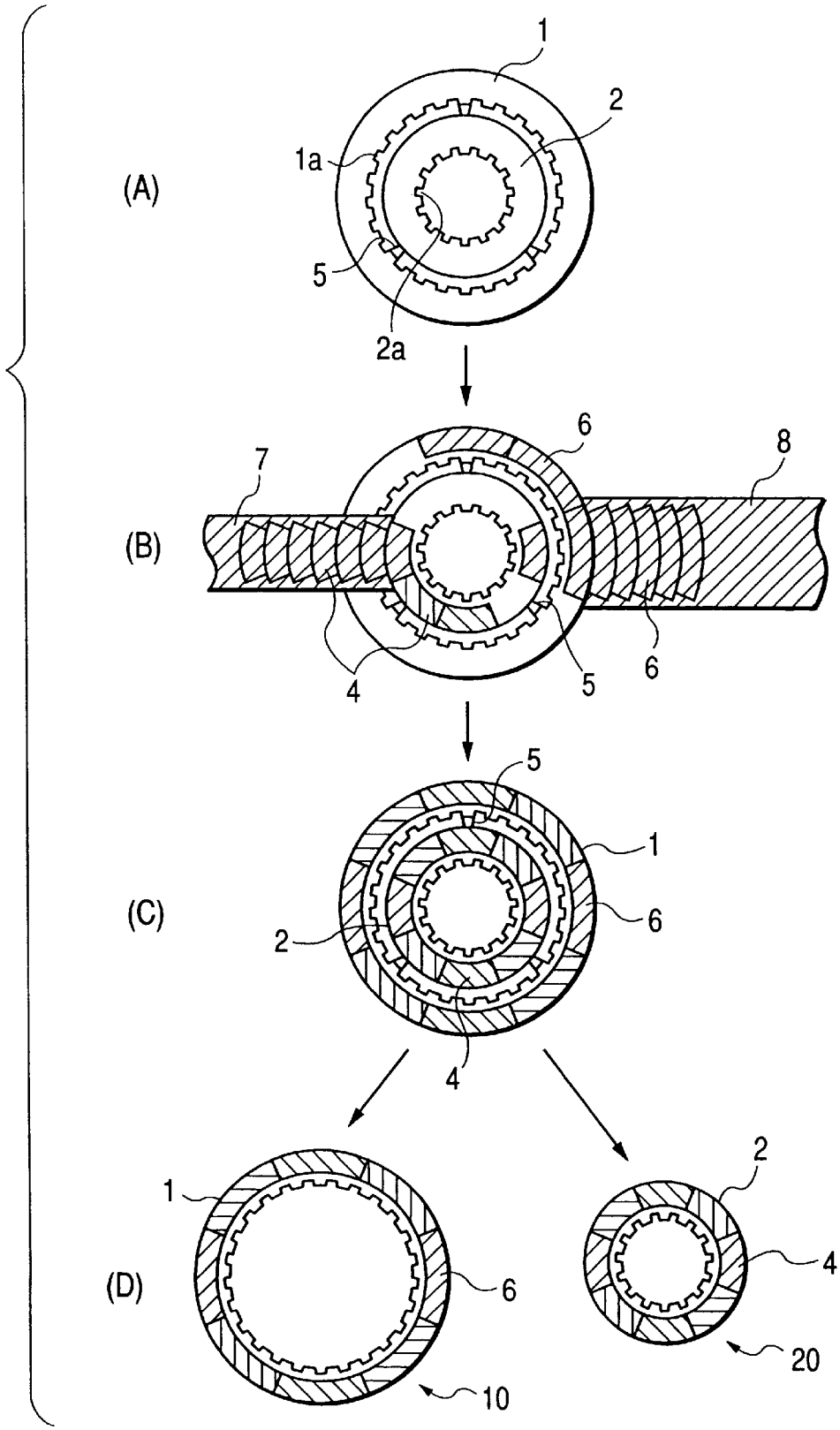
FIG. 2 is a plan view showing a flow of manufacturing processes in a second embodiment of the present invention.

FIG. 2 is a plan view showing a flow of manufacturing processes in a second embodiment of the present invention.

FIG. 2 shows a flow of processes or steps when two large and small friction plates having different diameters are manufactured, as is in the first embodiment. The second embodiment differs from the first embodiment only regarding a step (B), and, since the other steps are the same as those in the first embodiment, explanation thereof will be omitted.

In the step (B), a supplying direction of a friction tape 8 from which the friction member segments 6 for the large core plate 1 are stamped is opposite to a supplying direction to a friction tape 7 from which the friction member segments 4 for the small core plate 1 are stamped, and the supplying directions are opposed to each other. That is to say, in the first embodiment, while two kinds of friction member segments were stamped from the single friction tape 3, in the second embodiment, the friction member segments are stamped from the respective friction tapes.

Although the number of the friction tapes is increased, since the supplying directions of the friction tapes are opposed to each other, the friction member segments 4, 6 can be adhered one by one at once simultaneously, so that the time when the friction member segments are adhered onto the entire surfaces of the large core plate 1 and the small core plate 2 is the same as that in the first embodiment.

In the first embodiment, while the friction member segments 4, 6 were stamped from the friction tape 3 at the predetermined pitch, in the second embodiment, as apparent from the view showing the step (B), since the friction member segments 4, 6 are stamped substantially without any gap, the yield of the friction members is improved.

(Third Embodiment)

Figure 3:
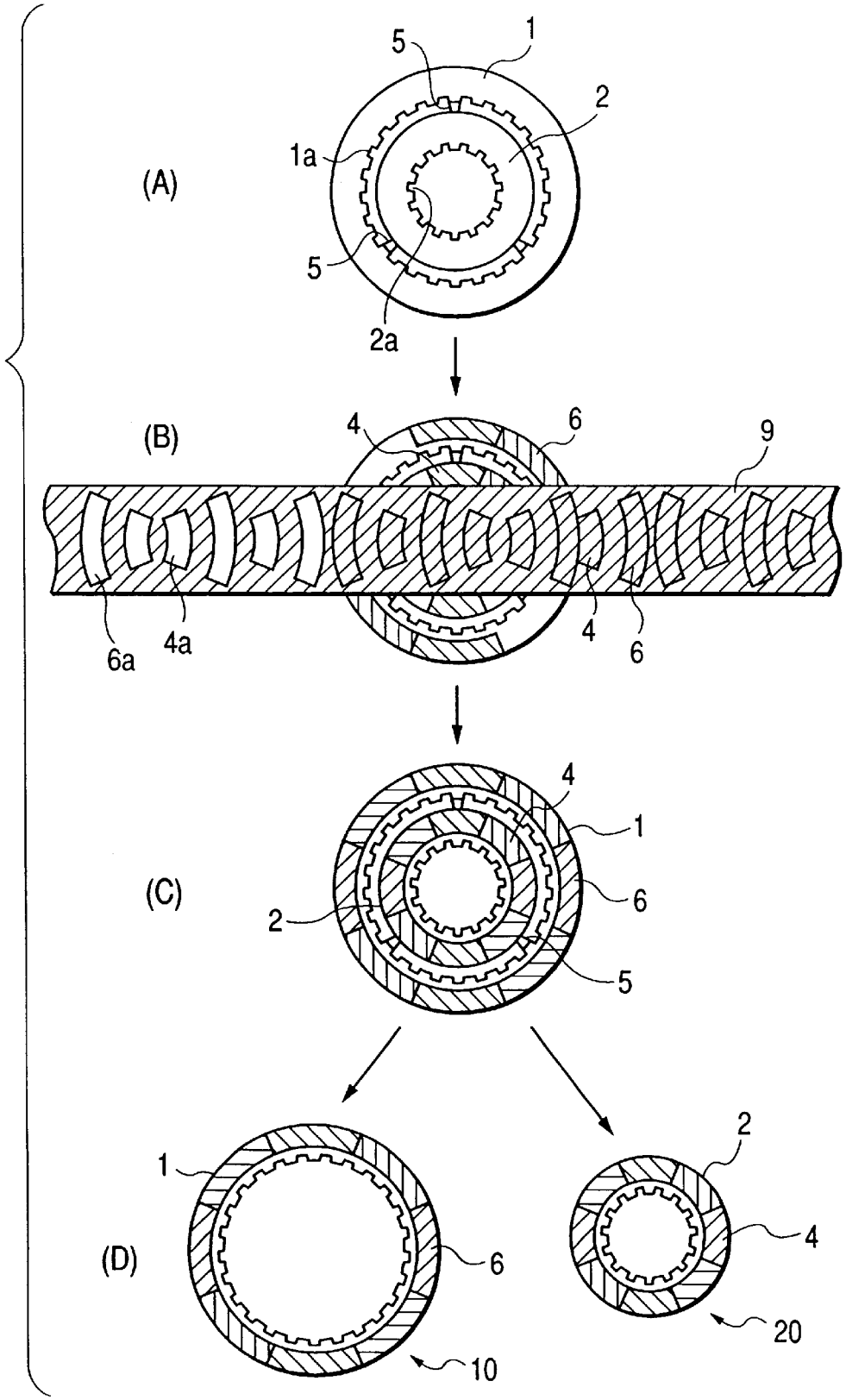
FIG. 3 is a plan view showing a flow of manufacturing processes in a third embodiment of the present invention.
Figure 4:
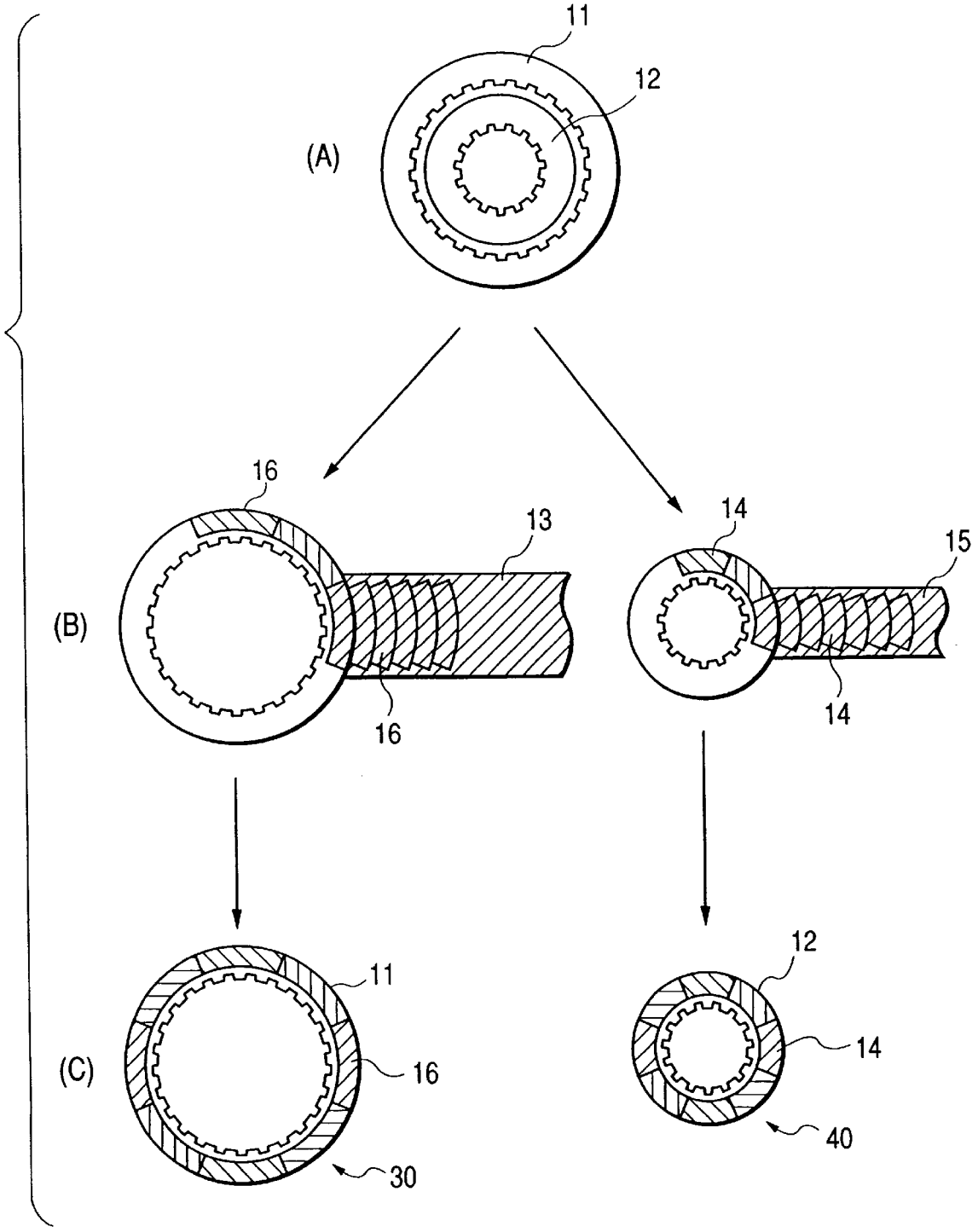
FIG. 4 PRIOR ART
FIG. 4 is a plan view showing a flow of conventional manufacturing processes.

FIG. 3 is a plan view showing a flow of manufacturing processes in a third embodiment of the present invention.

FIG. 3 shows a flow of processes or steps when two large and small friction plates having different diameters are manufactured, as is in the first embodiment. The third embodiment differs from the first embodiment only regarding a step (B), and, since the other steps are the same as those in the first embodiment, explanation thereof will be omitted.

In the step (B), a method for supplying the friction members in the third embodiment differs from those in the first and second embodiments. A single friction tape 9 from which the friction member segments 6 for the large core plate 1 and the friction member segments 4 for the small core plate 2 are stamped is supplied to both entire core plates.

As shown in the step (B), the friction tape 9 is supplied while changing the supplying pitch to 1→3→1→3, so that the segments are adhered to diametrically opposed portions of each core plate. Two friction member segments 4 and two friction member segments 6 which are concentric (four in total), and, adjacent to this, two friction member segments 4 and two friction member segments 6 which are concentric but have different phase deviated by 180 degrees (four in total) are stamped from the friction tape 9 in a condition that the segments are disposed side by side at a predetermined pitch.

Accordingly, two friction member segments 4 opposed in the radial direction and two friction member segments 6 opposed in the radial direction (four in total) are stamped at once from the friction tape 9, and the stamped segments are preliminarily adhered to the large and small core plates. As a result, in comparison with the first and second embodiments, the repeated stamping and adhering operations can be reduced to half.

As in the first embodiment, in the third embodiment, since only the single friction member supplying device is required and the number of the repeated stamping and adhering operations is reduced, the preliminary adhering time can be shortened.

In the above-mentioned embodiments, while an example that the friction plates are formed by simultaneously stamping the core plates and the friction members having two different diameters was explained, the kind of the friction plates is not limited to two, but, for example, three or more kinds of friction plates can be formed simultaneously.

As mentioned above, according to the friction plate manufacturing method of the present invention, the following advantages can be obtained.

The friction member segments can be adhered to the plural kinds of core plates, and the yield of material can be maintained in the same level as the conventional technique.

Further, by supplying the friction member segments while varying the pitch and by adhering the friction member segments on opposite portions of each core plate simultaneously, the number of the repeated stamping and adhering operations can be reduced to half, and a production cycle per core plate can be shortened.

What is claimed is:

1. A method for manufacturing friction plates obtained by adhering friction members to substantially annular core plates, comprising:

simultaneously stamping a plurality of substantially concentric core plates having different diameters with a joint portion remaining therebetween;

preliminarily adhering friction member segments to the joined plural core plates; and stamping said joint portion during or after main adhering following said preliminary adhering.

2. A method for manufacturing friction plates according to claim 1, wherein, in said preliminary adhering, said friction member segments are supplied from separate supplies for the respective core plates.

3. A method for manufacturing friction plates according to claim 2, wherein said separate supplies are provided along different radial directions.

4. A method for manufacturing friction plates according to claim 1, wherein, in said preliminary adhering, said friction member segments are supplied from a common supply to all of said plural core plates.

5. A method for manufacturing friction plates according to claim 4, wherein friction member segments from said common supply are substantially simultaneously adhered to diametrically opposed portions of each core plate.

6. A method for manufacturing friction plates obtained by adhering friction members to substantially annular core plates, comprising:

providing a plurality of core plates having different diameters in a substantially concentric arrangement; and adhering friction member segments to the substantially concentrically arranged core plates.

7. A method according to claim 6, wherein said segments are adhered in a plurality of adhering operations.

8. A method according to claim 7, further comprising relatively rotating said core plates and at least one supply of said segments between each of said adhering operations.

9. A method according to claim 8, wherein said core plates are held in circumferentially fixed relationship with each other during said relative rotation.

10. A method according to claim 9, wherein said core plates are held in said circumferentially fixed relationship by an interconnecting joint portion of said core plates.

11. A method for manufacturing friction plates according to claim 10, wherein said providing comprises simultaneously stamping said core plates so that said interconnecting joint portion remains therebetween following said stamping.

12. A method according to claim 7, wherein said friction member segments are supplied to said core plates so that at least one corresponding segment is positioned for adhering to each core plate during each adhering operation.

13. A method according to claim 12, wherein corresponding friction member segments are positioned for adhering to diametrically opposed portions of each core plate during each adhering operation.

14. A method according to claim 6, wherein said providing comprises simultaneously stamping said core plates so that an interconnecting joint portion remains therebetween following said stamping.

* * * * *